US009302526B1

(12) United States Patent
Saino

(10) Patent No.: US 9,302,526 B1
(45) Date of Patent: Apr. 5, 2016

(54) IMAGE ERASING APPARATUS CONFIGURED TO TURN OVER A SHEET AND METHOD FOR PROCESSING A SHEET

(71) Applicants: KABUSHIKI KAISHA TOSHIBA, Tokyo (JP); TOSHIBA TEC KABUSHIKI KAISHA, Tokyo (JP)

(72) Inventor: Hisashi Saino, Numazu Shizoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/813,506

(22) Filed: Jul. 30, 2015

(51) Int. Cl.
*B41J 2/01* (2006.01)
*B41M 7/00* (2006.01)
*B41J 29/38* (2006.01)

(52) U.S. Cl.
CPC ..... *B41M 7/0009* (2013.01); *B41J 29/38* (2013.01)

(58) Field of Classification Search
CPC ..... B41J 2/01; B41J 29/38; B41M 7/0009
See application file for complete search history.

(56) References Cited

U.S. PATENT DOCUMENTS

2010/0272449 A1* 10/2010 Yoshida ..... H04N 1/32133 399/2
2011/0305851 A1* 12/2011 Wang ..... B41M 5/52 428/32.31
2015/0054905 A1 2/2015 Saino et al,
2015/0231893 A1 8/2015 Yahata

* cited by examiner

*Primary Examiner* — Thinh Nguyen
(74) *Attorney, Agent, or Firm* — Patterson & Sheridan, LLP

(57) ABSTRACT

An image erasing apparatus includes a reading unit configured to read identifiers printed on each of first and second surfaces of a sheet, an erasing unit, a sheet storage unit, a conveying unit configured turn over the sheet while conveying the sheet, and a control unit. The control unit is configured to determine a first number of times the first surface of the sheet has been subjected to an erasing process and a second number of times the second surface of the sheet has been subjected to the erasing process, based on the identifiers read by the reading unit, control the conveying unit to turn over the sheet when the first number of times is smaller than the second number of times, and control the conveying unit to convey the sheet without turning over the sheet when the first number of times is greater than the second number of times.

19 Claims, 12 Drawing Sheets

IMAGE ERASING APPARATUS CONFIGURED TO TURN OVER A SHEET AND METHOD FOR PROCESSING A SHEET

FIELD

Embodiments described herein relate generally to an image erasing apparatus configured to erase an images formed with a decolorable color material on a sheet, and a method for processing a sheet.

BACKGROUND

In the related art, an image forming apparatus such as a Multi Function Peripheral (MFP) forms an image on a sheet using a decolorable color material. The decolorable color material may be decolored when heated to a predetermined high temperature.

An image erasing apparatus erases an image formed with the decolorable color material by heating the material to the predetermined high temperature and enables the sheet to be reused. The reuse of sheets may lead to sheet saving, and as a result, to conservation of the environment.

An image erasing apparatus of one type determines whether or not a sheet is reusable by scanning the surfaces of the sheet. Whether or not the sheet is reusable may be determined based on residual images on the sheet subjected to an erasing process, the condition of the sheet (deformation, damage, staining, and the like). In addition, as a sheet quality deteriorates if the sheet is subjected to the erasing process many times, a sheet subjected to the erasing process more than a certain number of times may be determined to be not reusable.

Further, when one surface of a sheet is subjected to the erasing process more frequently relative to the other surface of the sheet, the sheet may not be suitable for reuse. This is because such a sheet is likely to be curled and, as a result, tends to cause a sheet jam or a non-uniform stacking of sheets in the image erasing apparatus or the image forming apparatus.

DETAILED DESCRIPTION

In general, according to one embodiment, an image erasing apparatus includes a reading unit configured to read one or more identifiers printed on each of first and second surfaces of a sheet, an erasing unit configured to erase an image formed with a decolorable material on the sheet, a sheet storage unit, a conveying unit configured to convey the sheet through the reading unit and the erasing unit to the sheet storage unit and turn over the sheet while conveying the sheet, and a control unit. The control unit is configured to determine a first number of times the first surface of the sheet has been subjected to an erasing process and a second number of times the second surface of the sheet has been subjected to the erasing process, based on the identifiers read by the reading unit, control the conveying unit to turn over the sheet when the first number of times is smaller than the second number of times, and control the conveying unit to convey the sheet without turning over the sheet when the first number of times is greater than the second number of times.

Hereinafter, embodiments for implementing the invention will be described with reference to the drawings. Additionally, in each figure, same elements will be depicted with the same numerals.

First Embodiment

Figure 1:
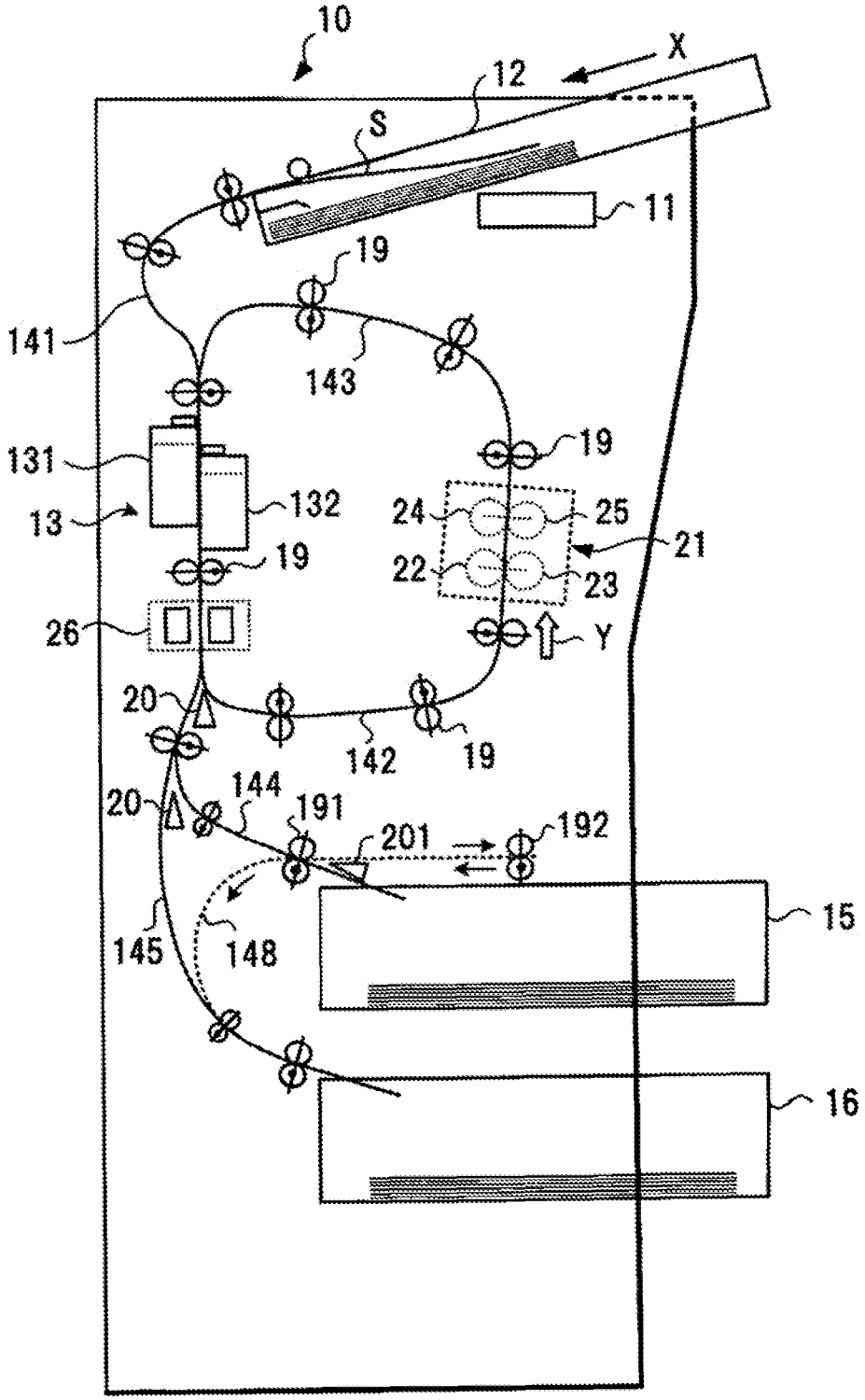
FIG. 1 illustrates an erasing apparatus according to a first embodiment.

FIG. 1 illustrates a configuration of an erasing apparatus 10. The erasing apparatus 10 is capable of erasing images on sheets of paper, which are formed using a decolorable color material. The sheets of paper from which images have been erased can be reused by an image formation apparatus.

The erasing apparatus 10 includes an operation unit 11, which includes an operation panel and display equipment, a paper supply unit 12, and a scanner 13. In addition, the erasing apparatus 10 includes first to fifth transport paths 141 to 145, and a plurality of paper cassettes 15 and 16. Along each of the first to fifth transport paths 141 to 145, a plurality of transport rollers 19 for transmitting sheets of paper is provided. The plurality of transport rollers 19 is respectively driven by motors.

Along the first transport path 141, sheets of paper S are conveyed from the paper supply unit 12 to the scanner 13. Along the second transport path 142, the sheets of paper S are conveyed from the scanner 13 in a direction of an arrow Y toward an erasing unit 21. Along the third transport path 143, the sheets of paper S are conveyed from the erasing unit 21 to the scanner 13 again. Along the fourth transport path 144, the sheets of paper S are conveyed to the paper cassette 15. Along the fifth transport path 145, the sheets of paper S are conveyed to the paper cassette 16. In addition, a plurality of gates 20 is provided in order to guide the sheets of paper in one of transport paths. Furthermore, the erasing unit 21 is provided along the transport path 142.

In addition, an inversion transport path 148, which turns over the front and rear sides of the sheet of paper S, is provided between the transport path 144 and the transport path 145. That is, beyond the transport path 144, the path branches into a pathway to transport the sheets of paper S from a transport roller 191 to the paper cassette 15 and a pathway to transport the sheets of paper S from the transport roller 191 to a transport roller 192. Sheets of paper S that are transported from the transport roller 191 to the transport roller 192 are turned over and are transported to the paper cassette 16 via the transport path 148. Therefore, the sheets of paper S may be transported to the paper cassette 16, according to necessity, by turning over the front and rear sides thereof. Additionally, whether to transport the sheets of paper S to the paper cassette 15, or whether to turn over and transport the sheets of paper S to the paper cassette 16 is controlled by switching a gate 201.

The paper cassette 15 is a cassette that stores sheets of paper (non-reusable sheets of paper) that are not suitable for reuse and will be used as a raw material for recycled paper.

In the present embodiment, when an allowable number of reuse times is set as N, sheets of paper that have been subjected to reuses for the number of times greater than or equal to N are stored in the paper cassette 15. Here, the number of reuse times may differ between two surfaces of the same sheet of paper. When the number of reuse times differs between the two surfaces, sheets of paper of which total number of reuse times on both surfaces is greater than or equal to N, are transported to the paper cassette 15.

The paper cassette 16 is a cassette that stores sheets of paper from which images are erased and that are suitable for reuse. In the present embodiment, sheets of paper of which number of reuse times is N or less are stored in the paper cassette 16. More specifically, sheets of paper of which number of reuse times on both surfaces is N or less, are transported to the paper cassette 16.

In the following description, the paper cassette 15 will be referred to as a reject cassette, and the paper cassette 16 will be referred to as a reuse cassette.

The erasing apparatus 10 in FIG. 1 generally performs the following erasing process. Firstly, a color-erasing and reading mode is selected using the operation unit 11. Subsequently, a sheet of paper S is transported from the paper supply unit 12 to the scanner 13 via the first transport path 141. The scanner 13 includes a first scanner 131 and a second scanner 132, and simultaneously reads both surfaces of the sheet of paper S. The scanner 13 generates image data prior to the color-erasing of images on the sheet of paper S by scanning the images. In addition, the scanner 13 reads marks, which are printed on the sheet of paper S.

Furthermore, the scanner 13 is used to determine a (toner) coverage rate and a condition of the sheet of paper S. The condition of the sheet of paper S is determined based on the image data generated by the scanner 13. For example, when it is determined that there is deformation such as tearing, creasing or the like, or damage such as punched holes or the like, on the sheet of paper S, the sheet of paper S is determined to be non-reusable. Sheets of paper S that are determined to be non-reusable are transported to the reject cassette 15 via the fourth transport path 144. In addition, sheets of paper that have high coverage rate are likely to be curled during the color-erasing. For this reason, such sheets of paper are determined to be non-reusable and are transported to the reject cassette 15. Sheets of paper S which do not have any tearing or creasing are transported to the erasing unit 21 by the second transport path 142.

The erasing unit 21 includes a first erasing unit, which includes a heat roller 22 and a press roller 23, and a second erasing unit, which includes a press roller 24 and a heat roller 25. Sheets of paper S are transported and heated between the heat roller 22 and the press roller 23, and between the press roller 24 and the heat roller 25. Each of the heat rollers 22 and 25 includes a heat source on the inside thereof. As the heat source, for example, it is possible to use a lamp.

In addition, a printing unit 26 is provided downstream with respect to the scanner 13 along the first transport path 141. The printing unit 26 prints identifiers (marks) that represent the number of reuse times on sheets of paper S.

Sheets of paper S that are transported to the erasing unit 21 are heated while passing through the erasing unit 21, and images formed on the sheets of paper S are color-erased by heat. The erasing unit 21 color-erases images on sheets of paper S by heating and pressurizing the sheets of paper S at a comparatively high temperature of 175° C. to 200° C., for example. That is, a coloring material that is capable of being color-erased is used in the formation of images of the sheets of paper S, and the coloring material is color-erased as a result of reaching the decoloring temperature.

Sheets of paper S that pass through the erasing unit 21 are transported to the scanner 13 again by the third transport path 143. In order to determine whether images have been color-erased, the scanner 13 scans the surface of the sheets of paper S again. Sheets of paper S from which images have been erased and which are determined to be reusable by the reading results of the scanner 13 are transported to the reuse cassette 16 via the fifth transport path 145.

Here, sheets of paper S on which images formed with a non-decolorable color material or images that are handwritten using pens or pencils are determined to remain in an image region based on the scan by the scanner 13, are transported to the reject cassette 15 via the fourth transport path 144. In addition, sheets of paper S having tearing or creasing are also transported to the reject cassette 15. Furthermore, the scanner 13 determines the number of reuse times by reading marks printed on the sheet of paper S. Further, sheets of paper S with the number of reuse times that is greater than or equal to a maximum allowable number of times (N times) are transported to the reject cassette 15.

Figure 2:
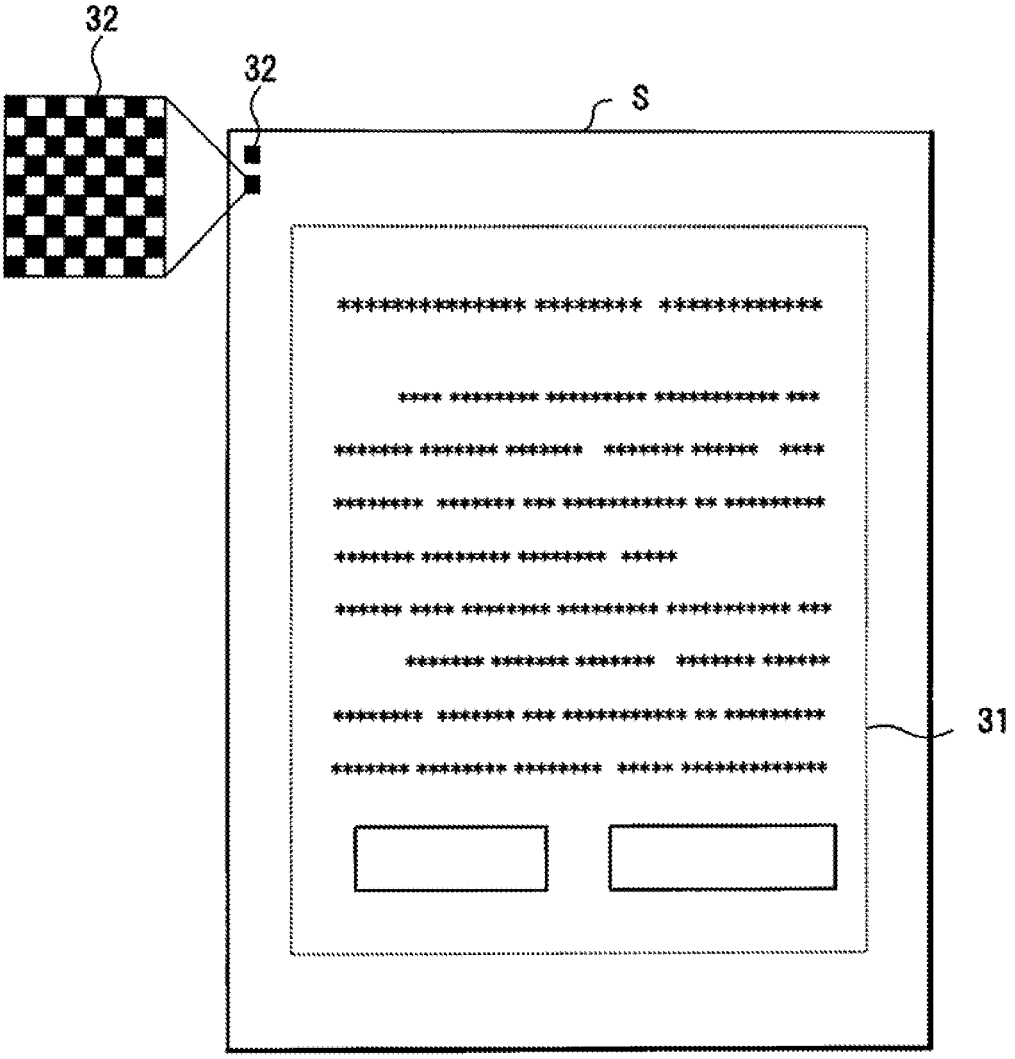
FIG. 2 illustrates an example of an image and identifiers (marks) that are formed on a sheet of paper.

FIG. 2 shows an example of an image 31 and marks 32 that are formed on a sheet of paper S. The image 31 is an image that has been printed using a decolorable color material (such as decolorable toner or decolorable ink). In addition, the marks 32 are marks that are printed using non-decolorable color material that is not erased even if heated.

The scanner 13 determines the number of reuse times with respect to each sheet of paper S by reading the marks 32. For example, information (images 31 and marks 32) of both surfaces of a sheet of paper S that has been read by the scanner 13 is stored in a storage unit of the erasing apparatus 10 with respect to each sheet of paper. In addition, the scanner 13 counts the number of reuse times at a current point in time by counting the number of marks 32.

Further, when an allowable number of reuse times is set as N, sheets of paper of which number of reuse reaches an $N^{th}$ time are transported to the reject cassette 15 via the fourth transport path 144. It is desirable that the marks 32 are printed in a corner of the sheet of paper S at a size that does not stand out.

In addition, the printing unit 26 prints a new mark 32 on a sheet of paper each time an image is erased by the erasing apparatus 10. For example, when reuse is performed n times, the printing unit 26 prints n marks 32. The marks 32 are printed on the front and rear surfaces of a sheet of paper depending on respective numbers of reuses of each surface. In addition, the marks 32 are printed with the positions thereof shifted from one another so as not to overlap. If either a front surface or a rear surface of a sheet of paper is determined to be a blank surface (in other words, does not have anything printed thereon) based on the scan by the scanner 13, a mark is not printed on the blank surface. The marks 32 serve as identifiers of the number of reuse times of the front and rear surfaces of a sheet of paper.

For example, the marks 32 are printed at the top left of a front side in a transport direction of the sheet of paper S as shown in FIG. 2. For example, the size of the mark 32 is 2.25 mm±0.25 mm in length and width, and the marks 32 are formed in positions that are 3 mm±3 mm from the top end of a sheet of paper. In addition, an uppermost mark 32 is formed in a position that is 10 mm±3 mm from an upper end of a sheet of paper, and an interval between marks 32, which are adjacent in a vertical direction, is 10 mm±3 mm. For example, a single mark 32 is 8 dots×9 dots 2.12 mm×2.29 mm).

Figure 3:
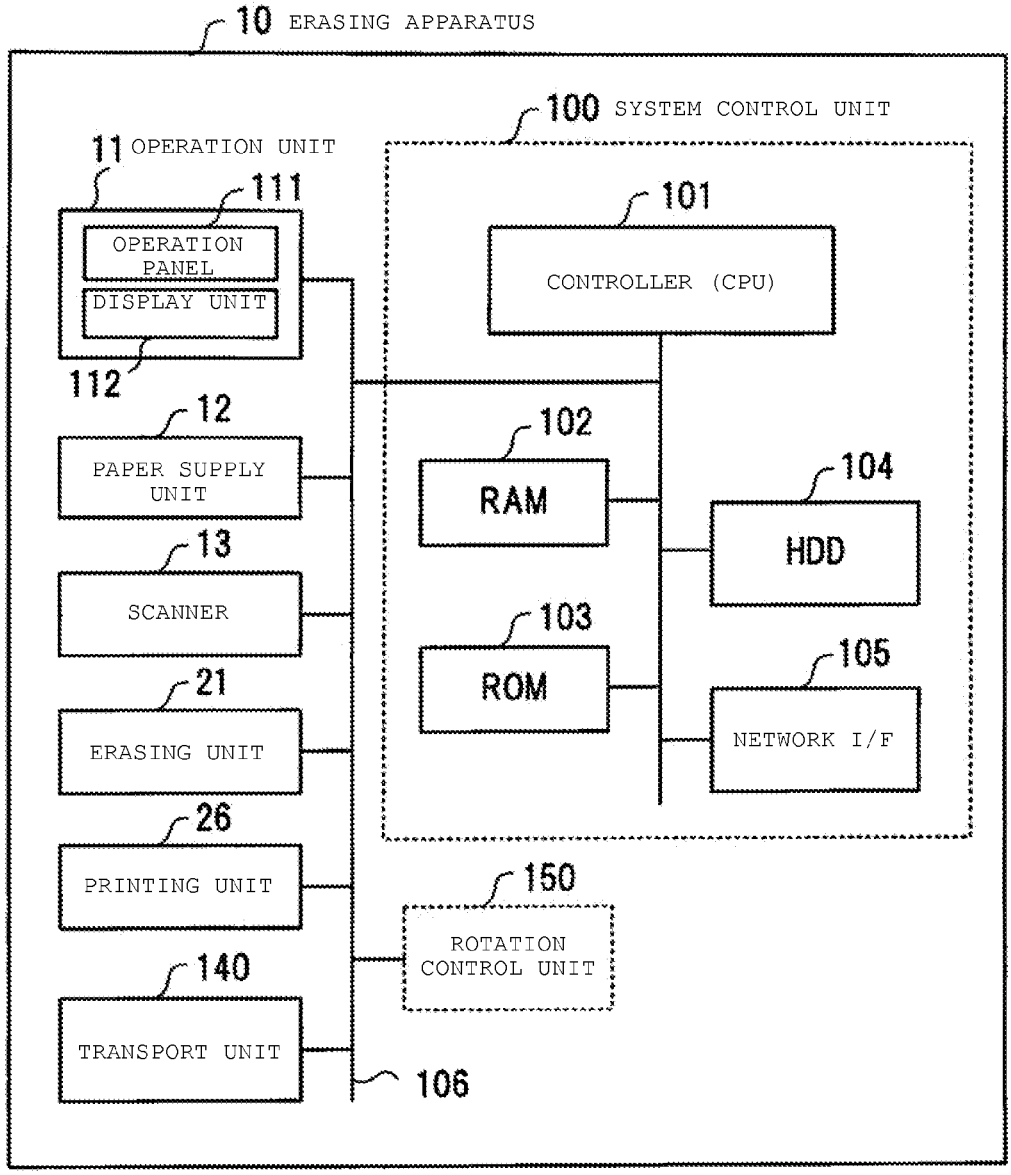
FIG. 3 is a block diagram illustrating a control system of the erasing apparatus according to the first embodiment.

FIG. 3 is a block diagram illustrating a control system of the erasing apparatus 10. The erasing apparatus 10 includes a system control unit 100 that performs overall control of each unit of the erasing apparatus 10. The system control unit 100 includes, for example, a CPU 101, which is a controller, a random access memory (RAM) 102, a read only memory (ROM) 103, a hard disk drive (HDD) 104, a network interface (I/F) 105, and the like.

In addition, the operation unit 11, the paper supply unit 12, the scanner 13, the erasing unit 21, the printing unit 26, and a transport unit 140 are connected to the system control unit 100 via a bus 106. The operation unit 11 includes an operation panel 111 and a display unit 112, and the transport unit 140 includes a motor (not shown in FIG. 3) that rotates the plurality of transport rollers 19 that is arranged in each of the transport paths 141 to 145.

The CPU 101 performs various processing functions by executing control programs that are stored in the ROM 103. The RAM 102 is a main memory that functions as working memory. The ROM 103 stores control programs, control data, and the like for controlling the erasing apparatus 10 and performing various processing functions.

The HDD 104 is a large capacity memory for storing data. For example, image data of the image and the marks 32 that are read by the scanner 13 and the like are stored in the HDD 104. The network interface (I/F) 105 performs communication between an image formation apparatus and other external devices (such as a PC) using a local area network (LAN), for example.

FIGS. 4A to 4D are drawings that describe insertion directions of sheets of paper S which are set on the paper supply unit 12 of the erasing apparatus 10. In the present embodiment, it is assumed that A4 size sheets of paper are used. Here, one surface of a sheet of paper S will be referred to as an A surface, and the other surface thereof will be referred to as a B surface.

Figure 4A:
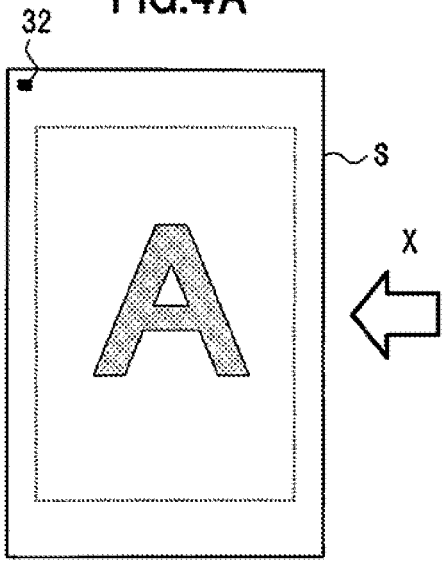
FIGS. 4A to 4D illustrate orientations of a sheet of paper when the sheet of paper is set in an erasing apparatus.
Figure 4B:
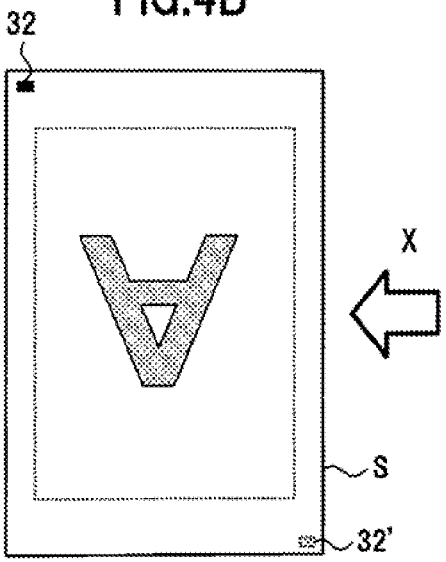

As shown in FIG. 4A, sheets of paper S are normally set from an arrow X direction with the A surface facing upward. When a sheet of paper S is set in this manner, a mark 32 formed by the printing unit 26 is positioned at the top left of a front side of the sheet of paper S. In addition, as shown in FIG. 4B, sheets of paper S may be set from the arrow X direction with the A surface being turned upside down. A mark 32 is also formed by the printing unit 26 at the top left of a front side of a sheet of paper S in this state. In FIG. 4B, a mark 32' that shows the number of times that the sheet of paper S has already been reused, is formed in corner section (bottom right) on the diagonal of the sheet of paper S.

Figure 4C:
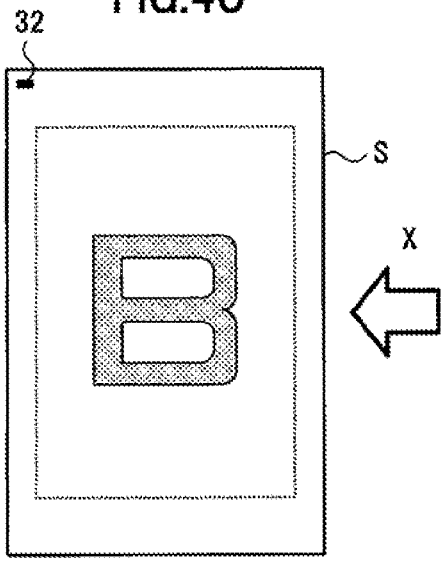
Figure 4D:
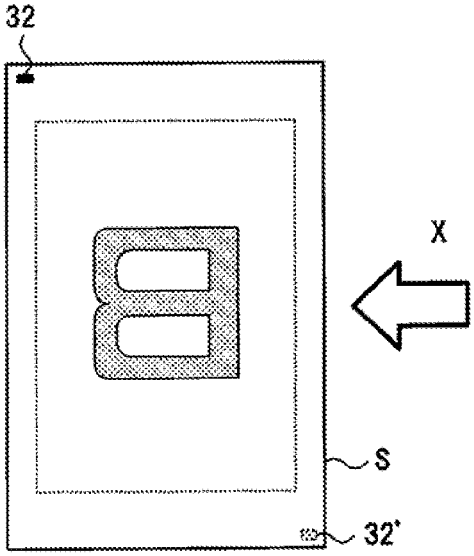

In addition, as shown in FIG. 4C, sheets of paper S may be set from an arrow X direction with the B surface facing upward. When a sheet of paper S is set in this state, a mark 32 is formed by the printing unit 26 at the top left of a front side of the sheet of paper. Furthermore, as shown in FIG. 4D, there are also cases in which sheets of paper S are set from the arrow X direction with the B surface being turned upside down. A mark 32 is also formed by the printing unit 26 at the top left of a front side of a sheet of paper S in this state. In FIG. 4D, a mark 32' which shows the number of times that the sheet of paper S has already been reused is formed in corner section (bottom right) on the diagonal of the sheet of paper S.

Accordingly, the number of reuse times (number of erases) of a sheet of paper S up to this point of time can be determined by counting a total number of the marks 32 and 32' of the A surface and the B surface.

As shown in FIGS. 4A to 4D, there are four setting patterns of sheets that are to be subjected to the erasing process. However, if the A surface is often set facing upward, since the A surface is likely to be more frequently reused than the B surface, the sheet of paper S is likely to be curled because forming of a coloring material and heating are more repeatedly performed on the A surface. In addition, the A surface may include more color residue, as the A surface is more subject to the erasing. If the sheet of paper S is curled, jamming is more likely to be caused inside the erasing apparatus 10. In addition, the curled sheet of paper S may not be properly stacked when sheets of paper S are transported to the paper cassette 16.

To deal with such issues, in the erasing apparatus 10 according to the present embodiment, the marks 32 that indicate the number of reuse times are read by the scanner 13. In addition, when a sheet of paper that is determined to be reusable is transported to the reuse cassette 16, total numbers of the marks 32 and 32' on each of the A surface and the B surface are calculated. Further, the sheet of paper is transported to the reuse cassette 16 so that the surface with the lower total number is on an upper side (or a bottom side).

Hereinafter, image erasing of a sheet of paper S, and transportation of the sheet of paper S in the erasing apparatus 10 will be described. The erasing apparatus 10 can determine the number of reuse times by reading the marks 32 and 32'. When an allowable number of reuse times is set as N, sheets of paper of which number of reuse times reaches N are transported to the reject cassette 15. In addition, sheets of paper with the number of reuse times that is N or less are transported to the reuse cassette 16 in a manner in which a surface on which a subtotal number of marks 32 and 32' is lower, is on an upper side.

Figure 5:
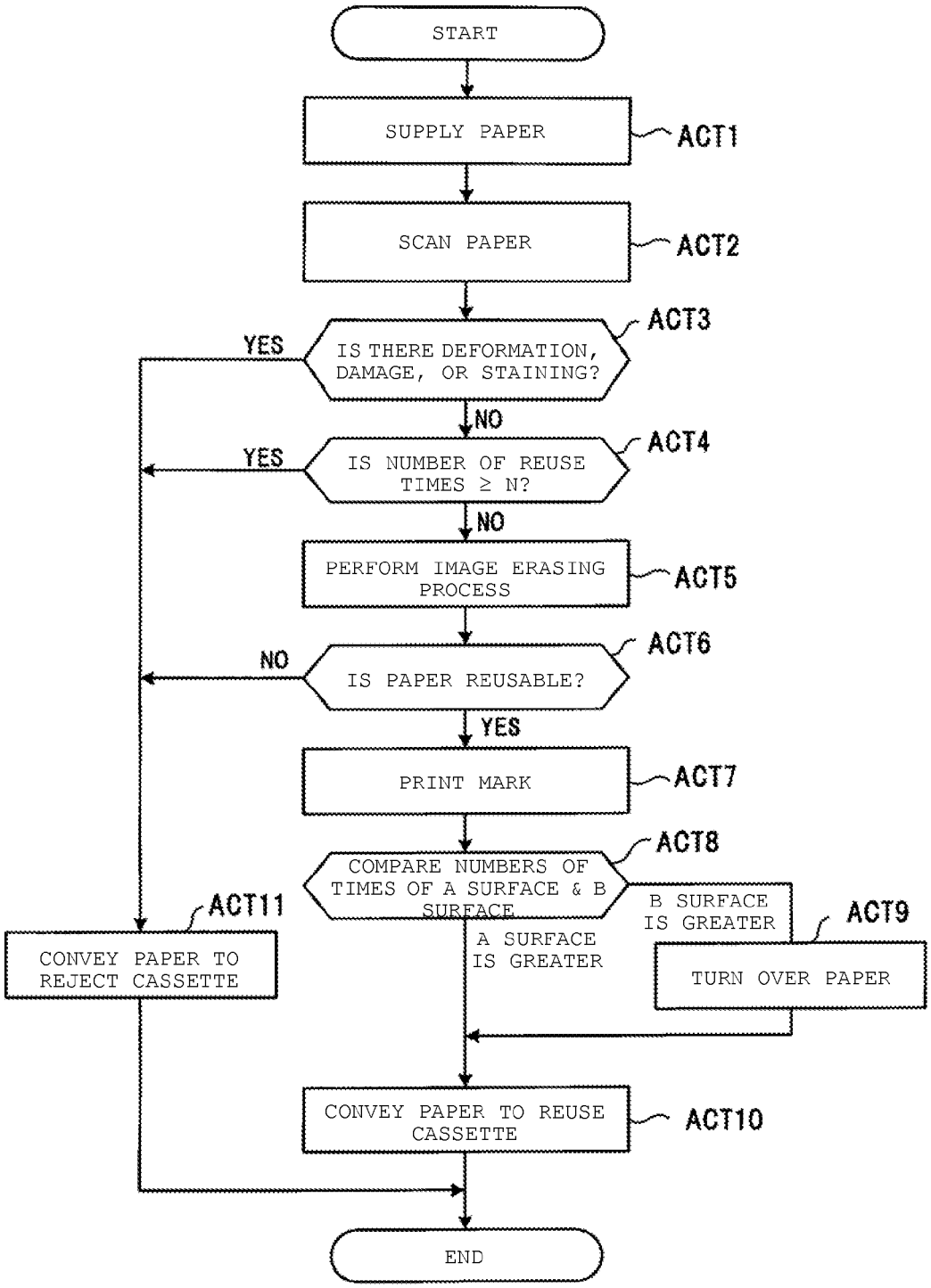
FIG. 5 is a flowchart illustrating sheet transportation and image erasing carried out by the erasing apparatus according to the first embodiment.

FIG. 5 is a flowchart illustrating the image erasing and the transportation of the sheets of paper S, which are performed according to the control of the CPU 101. In ACT1 in FIG. 5, the CPU 101 operates so that a sheet of paper S is supplied from the paper supply unit 12. In ACT2, the CPU 101 controls the scanner 13 to scan images (including marks 32 and 32') that are printed on the sheet of paper S. The CPU 101 controls a storage unit such as the HDD 104 to store image data generated by the scanner. Then, in ACT3, the CPU 101 determines the condition of the sheet of paper S.

Specifically, in ACT3, the CPU 101 determines whether or not there is deformation, damage, or staining on the sheet of paper S based on a scanning result by the scanner 13. When it is determined that there is deformation, damage, or staining (YES in ACT3), the CPU 101 determines that the sheet of paper S is non-reusable. When the sheet of paper S is non-reusable, the process proceeds to ACT11, and the CPU 101 controls the transport unit 140 to transport the sheet of paper S to the reject cassette 15.

When it is determined that there is not deformation, damage, or staining in ACT3 (NO in ACT3), in ACT4, the CPU 101 determines whether or not the number of reuse times of the sheet of paper S is the allowable number of times (N times) or less. In other words, in ACT4, the number of marks 32 and 32' that are included in an image that has been read in ACT2 is determined. Then, if the number of the marks 32 and 32' are greater than or equal to N, the process proceeds to ACT11, and the CPU 101 controls the transport unit 140 to transport the sheet of paper S to the reject cassette 15.

Here, the scanner 13 may read the sheet of paper S twice, i.e., when the sheet of paper S is supplied from the paper supply unit 12 and when the sheet of paper S is supplied from the erasing unit 21 after images have been erased therefrom by the erasing unit 21. The CPU 101 determines the number of reuse times of the sheets of paper S based on reading information when the sheet of paper S is supplied from the paper supply unit 12.

Furthermore, when it is determined in ACT4 that the number of reuse times is N or less (NO in ACT4), the CPU 101 transports the sheet of paper S to the erasing unit 21 via the second transport path 142 in order to erase images on the sheet of paper Sin ACT5. Images on the sheet of paper S are subjected to an erasing process by the erasing unit 21. In addition, in the subsequent ACT6, the CPU 101 determines whether or not the sheet of paper S is reusable based on the reading result of the sheet of paper S by the scanner 13.

In ACT6, for example, when there are erasure residues that cannot be erased or there is deformation, damage, or staining, a sheet of paper S is determined to be non-reusable. In this case, the process proceeds to ACT11 and the CPU 101 controls the transport unit 140 to transport the sheet of paper S to the reject cassette 15. Here, although the marks 32 and 32' cannot be erased, the marks 32 and 32' are negligible because the marks 32 and 32' are small.

When it is determined in ACT6 that the sheet of paper S is reusable (YES in ACT6), the process proceeds to ACT7. In ACT7, the CPU 101 controls the printing unit 26 to print one additional mark 32 on the sheet of paper S. Here, when either a front surface or a rear surface is determined to be a blank surface based on the reading result by the scanner 13, a mark is not printed on the blank surface.

Next, in ACT8, the CPU 101 compares the number of reuse times of the A surface and the B surface. When the number of reuse times of the A surface is greater than the number of reuse times of the B surface, the process proceeds to ACT10, and the CPU 101 controls the transport unit 140 to transport the sheet of paper S to the reuse cassette 16 without turning over the sheet. As a result, the sheet of paper S is transported to the reuse cassette 16 in a manner in which the A surface of the sheet of paper S is facing downward, and the B surface thereof is facing upward.

Meanwhile, when the number of reuse times of the B surface is greater than the number of reuse times of the A surface, the CPU 101 controls the transport unit 140 to turn over the upper and bottom side of the sheet of paper S and transport the sheet of paper S to the reuse cassette 16 in ACT9. That is, the sheet of paper S is transported by the transport rollers 191 and 192 from the transport path 144 to the reuse cassette 16 to be turned over via the inversion transport path 148. As a result, the front and rear sides of the sheet of paper S are inverted, and the sheet of paper S is transported to the reuse cassette 16 in a manner in which the A surface is facing upward, and the B surface is facing downward.

When the numbers of reuses of the A surface and the B surface of a sheet of paper S are the same, that is, the numbers of printed marks 32 and 32' are the same, it is not necessary to turn over the sheet of paper S.

In the abovementioned manner, according to the first embodiment, the number of reuse times (number of erases) is determined by detecting the marks 32 and 32' that are printed on a sheet of paper, and the sheet of paper is oriented so that a surface having a lower number of marks is facing upward when the sheet of paper is determined to be reusable and transported to the reuse cassette 16. Therefore, when sheets of paper are reused, it is possible to set the sheets of paper in an image formation apparatus so that images are formed on a surface having a lower number of reuse times. Accordingly, it is possible to reuse both the A surface and the B surface substantially equal, and as a result it may be able to reduce the curling and staining of the sheet.

Second Embodiment

Figure 6:
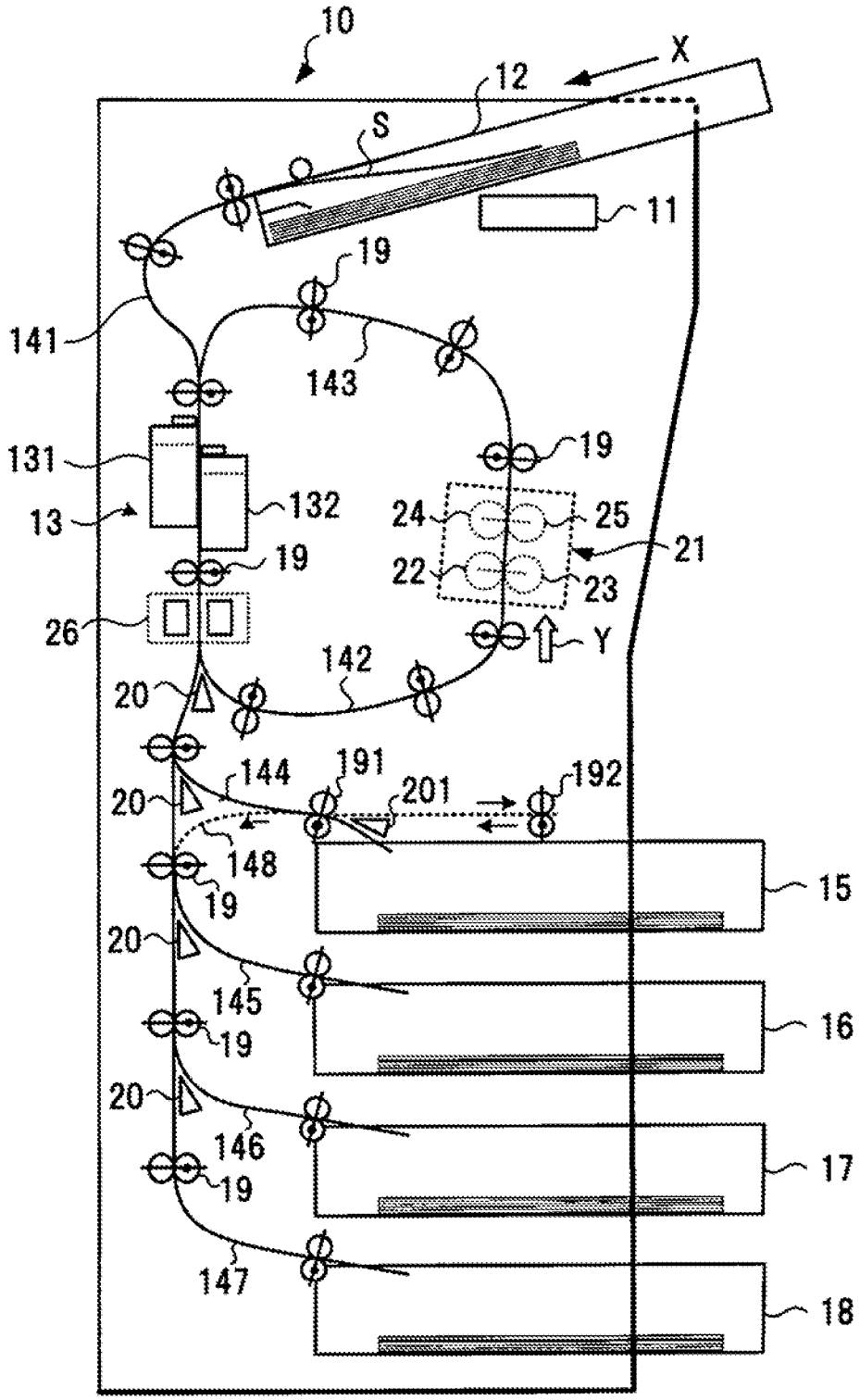
FIG. 6 illustrates an erasing apparatus according to a second embodiment.

Next, a configuration of an erasing apparatus according to a second embodiment will be described with reference to FIG. 6. In FIG. 6, the erasing apparatus 10 includes a plurality of paper cassettes 15 to 18, and the cassette 15 is set as a reject cassette. In addition, the plurality of paper cassettes other than the reject cassette 15, are set as reuse cassettes 16, 17, and 18. Further, sheets of paper are distributed and transported to the reuse cassettes 16, 17, and 18 depending on the number of reuse times thereof.

For example, when an allowable number of reuse times N is set as 10, sheets of paper for which the total number of reuse times is 1 to 3 are conveyed to the reuse cassette 16. In addition, sheets of paper for which the total number of reuse times is 4 to 6 are conveyed to the reuse cassette 17, and sheets of paper for which the total number of reuse times is 7 to 9 are conveyed to the reuse cassette 18. Sheets of paper for which the total number of reuse times is greater than or equal to 10 are conveyed to the reject cassette 15.

Figure 7:
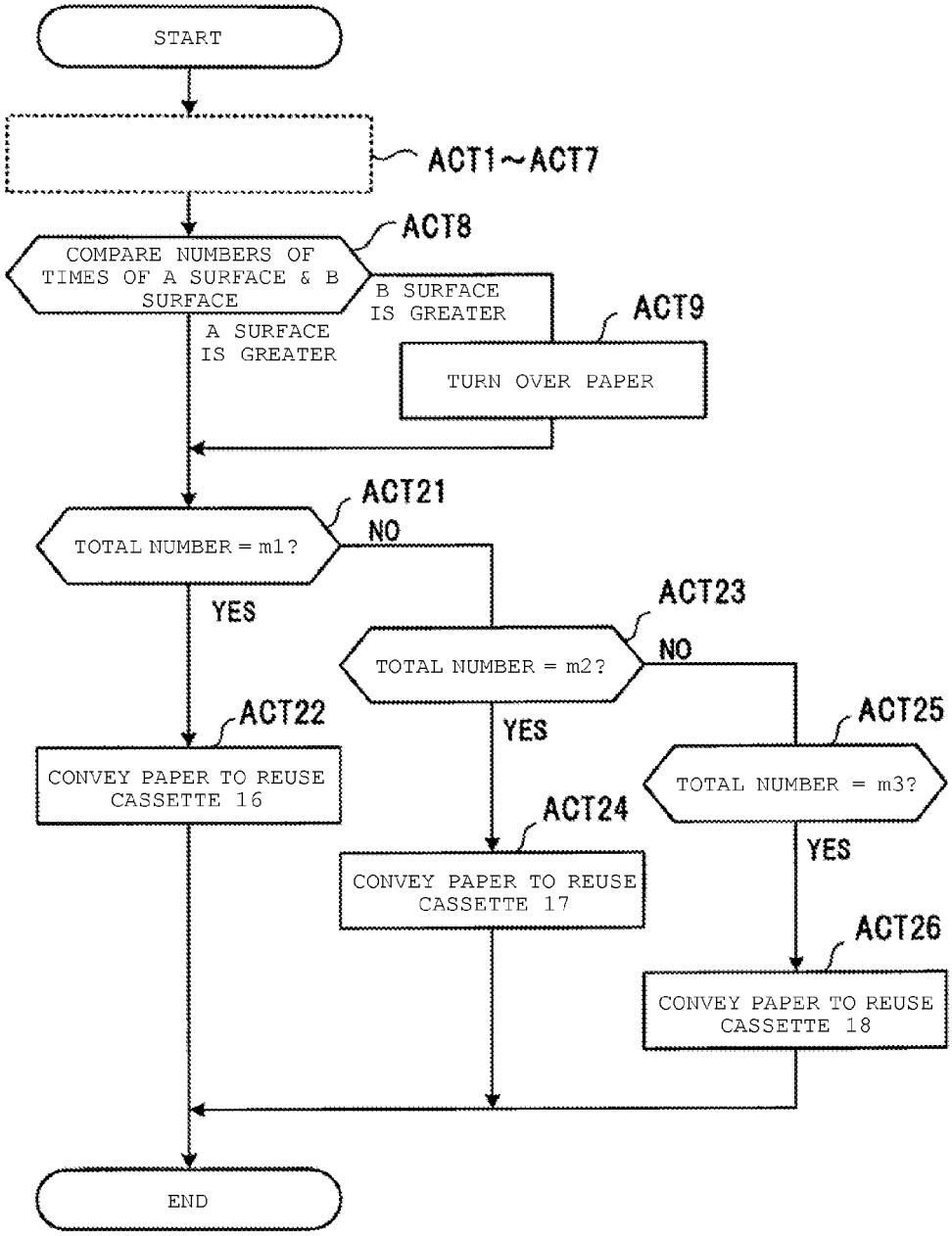
FIG. 7 is a flowchart illustrating sheet transportation carried out by the erasing apparatus according to the second embodiment.

FIG. 7 is a flowchart illustrating transportation of sheets of paper in an erasing apparatus according to the second embodiment. Since ACT1 to ACT7 are the same as ACT1 to ACT7 in FIG. 5, FIG. 7 focuses on ACT8 and subsequent steps thereof.

In ACT8, the CPU 101 compares the number of reuse times of the A surface and the B surface. When the number of reuse times of the A surface is greater than the number of reuse times of the B surface, the process proceeds to ACT21. Meanwhile, when the number of reuse times of the B surface is greater than the number of reuse times of the A surface, the CPU 101 controls the transport unit 140 to turn over the sheet of paper S and transport the sheet of paper S to the reuse cassette 16 in ACT9.

In ACT21, the CPU 101 determines whether or not the total number of reuse times of the A surface and the B surface is m1. For example, when an allowable number of reuse times N is set as 10 and the total number of reuse times is m1 (m1=1 to 3), the CPU 101 controls the transport unit 140 to transport the sheet of paper to the reuse cassette 16 in ACT22.

In addition, when the total number of reuse times is not m1 (NO in ACT21), the CPU 101 determines whether or not the total number of reuse times is m2 in ACT 23. When the total number of reuse times is m2 (m2=4 to 6), the CPU 101 controls the transport unit 140 to transport the sheet of paper to the reuse cassette 17 in ACT24.

Furthermore, when the total number of reuse times is not m2 (NO in ACT23), the CPU 101 determines whether or not the total number of reuse times is m3 in ACT25. When a total number of reuse times is m3 (m3=7 to 9), the CPU 101 controls the transport unit 140 to transport the sheet of paper to the reuse cassette 18 in ACT26.

In the abovementioned manner, in the erasing apparatus according to the second embodiment, it is possible to distribute and transport sheets of paper depending on the number of reuse times to one of the plurality of reuse cassettes 16 to 18. Therefore, a user may select sheets of paper with a preferred number of reuse times.

Here, the allowable number N is not limited to 10 and may be set arbitrarily. In addition, it is possible to set m1, m2, and m3 arbitrarily, whereby it is also possible to arbitrarily set distribution numbers depending on the number of reuse cassettes.

In addition, in the second embodiment, it is also possible to align and stack sheets of paper so that a surface having fewer marks is facing upward when reusable sheets of paper are transported to the reuse cassettes 16, 17, and 18.

Third Embodiment

Figure 8:
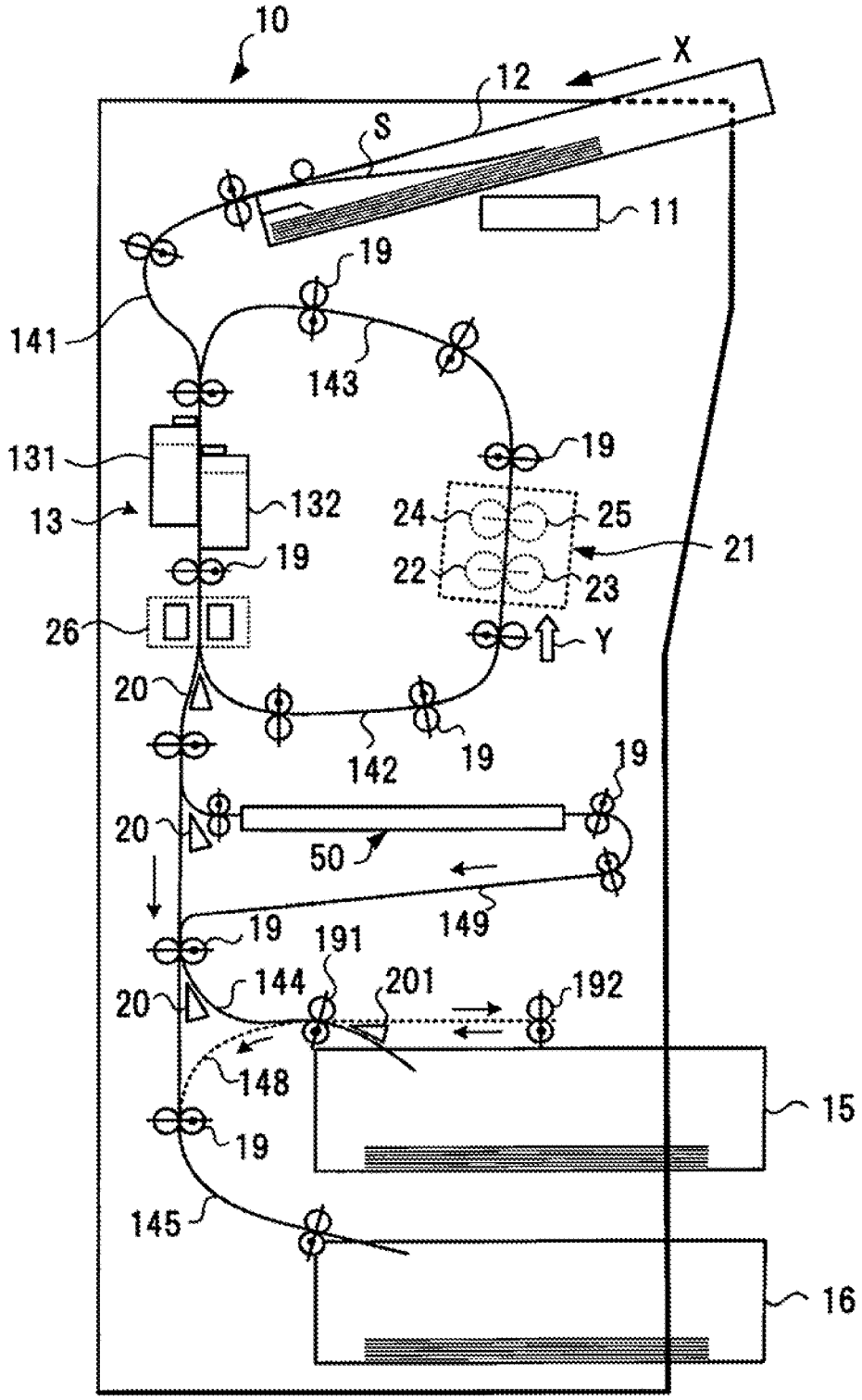
FIG. 8 illustrates an erasing apparatus according to a third embodiment.

Next, a configuration of an erasing apparatus according to a third embodiment will be described with reference to FIG. 8. In FIG. 8, the erasing apparatus 10 inverts a leading end side and a tailing end side of the sheet of paper S as necessary when sheets of paper S are transported to the reuse cassette. In addition, in the third embodiment, the erasing apparatus 10 includes the reject cassette 15 and the reuse cassette 16.

In FIG. 8, a transport path 149 is provided in the erasing apparatus 10, and the transport path 149 branches off from and merges with the transport path 144. A rotation device 50 that switches the leading end side and the tailing end side in a transport direction of a sheet of paper is provided along the transport path 149.

Figure 9A:
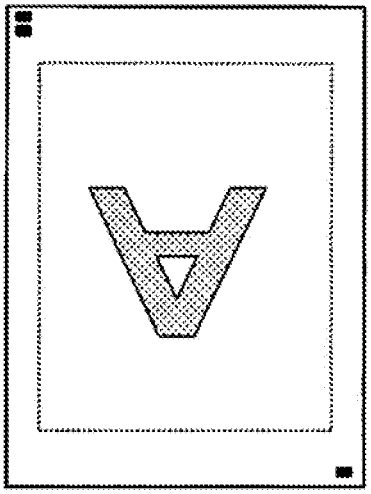
FIGS. 9A to 9C illustrate different orientation of the sheet switched by a rotation device of the erasing apparatus according to the third embodiment.
Figure 9B:
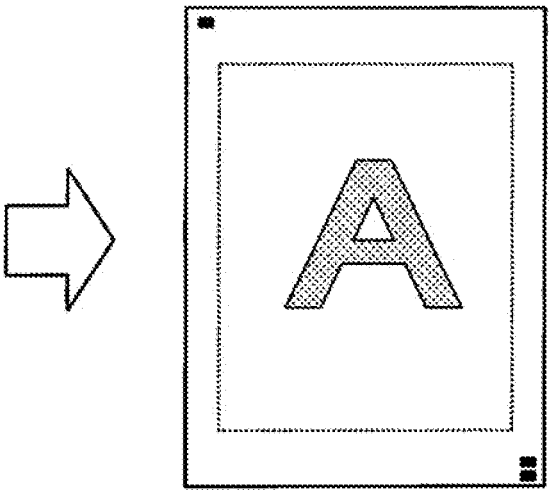

FIGS. 9A and 9B illustrate different orientations of a sheet that are switched by the rotation device 50. For example, by rotating the sheet of paper S that is shown in FIG. 9A, as shown in FIG. 9B, the leading end side and the tailing end side in a transport direction of the sheet of paper S are switched. First, marks 32 that are respectively printed in a corner section of the leading end side and a corner section of the tailing end side of the sheet of paper S are compared. Then, the rotation device 50 rotates the sheet of paper S so that a side with fewer marks 32 is oriented at the leading end side in the transport direction.

Figure 9C:
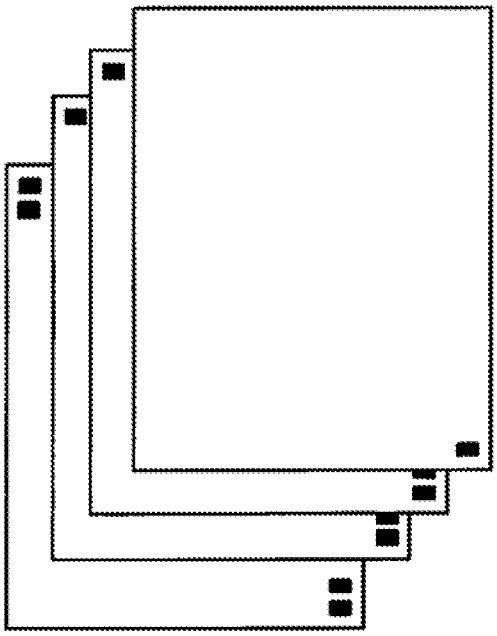

Therefore, as shown in FIG. 9C, sheets of paper that are transported to the reuse cassette 16 are aligned and stacked so that a side with a fewer number of marks 32 is oriented at the leading end side. In other words, sheets of paper are rotated by the rotation device 50 so that numbers of marks 32 on the leading end side and the tailing end side are close, and then transported to the reuse cassette 16.

Here, when the numbers of marks 32 that are printed on the leading end side and the tailing end side of a sheet of paper S are the same, it is not necessary to rotate the sheet of paper S.

Figure 10A:
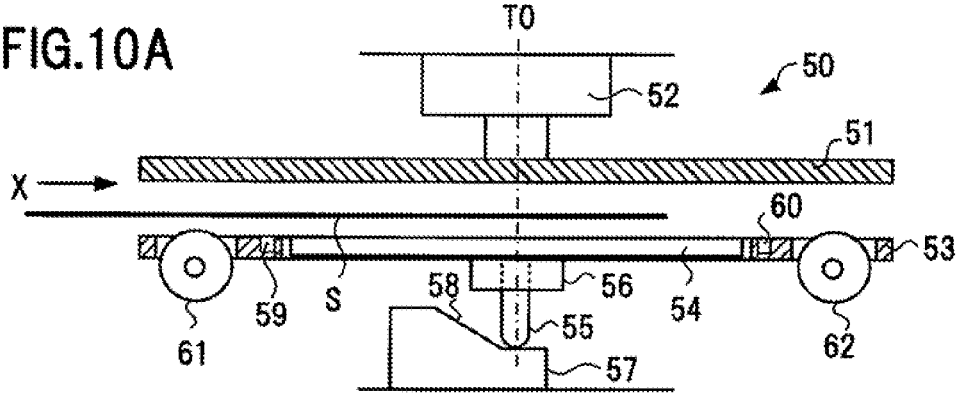
FIGS. 10A to 10C are side views of the rotation device according to the third embodiment.

FIG. 10A is a side view of the rotation device 50. The rotation device 50 includes a rotation plate 51 and a motor 52 that drives the rotation plate 51 about a central axis TO set as the center thereof. In addition, the rotation device 50 includes a support plate 53 that is opposite to the rotation plate 51 in a parallel manner. There is a circular hole in a center region of the support plate 53, and a disc-shaped turntable 54 that is capable of passing through the hole is provided. The turntable 54 includes a shaft 55 in the center thereof, and the shaft 55 is supported by a bearing 56 that is fixed to the support plate 53. In addition, a bottom end of the shaft 55 is supported by a slider 57.

Figure 10B:
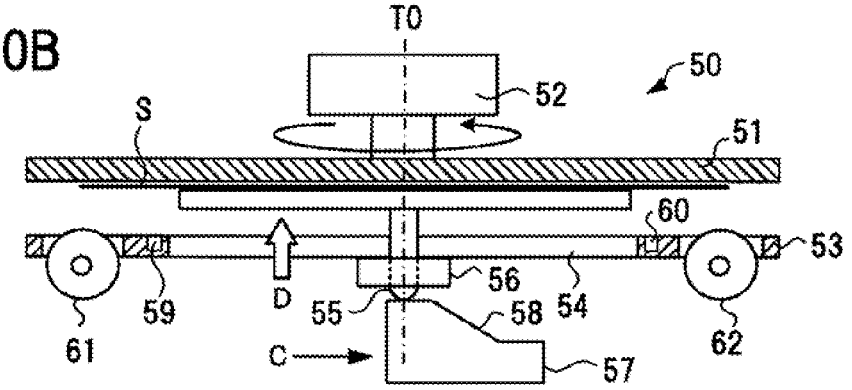
Figure 10C:
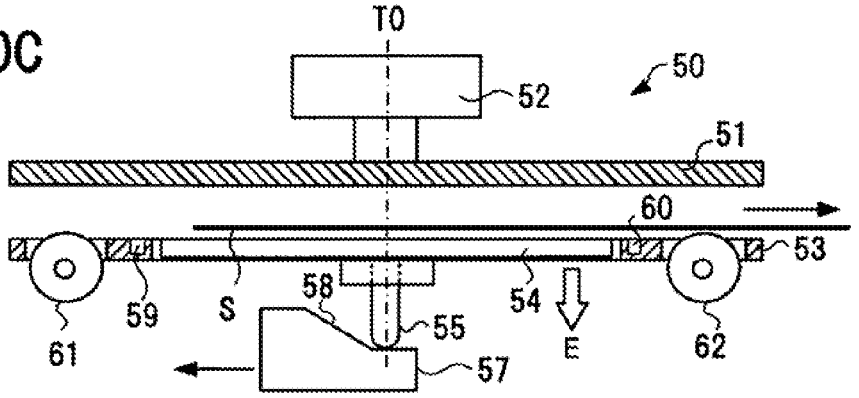

The slider 57 includes a tapered surface 58, and the bottom end of the shaft 55 rises along the tapered surface 58 as the slider 57 slides in a horizontal direction in FIGS. 10B and 10C. As the shaft 55 rises, the turntable 54 also rises. The slider 57 is reciprocated by a motor or the like. A gap through which sheets of paper S pass is produced between the rotation plate 51 and the support plate 53 when the turntable 54 is descended.

In addition, sensors 59 and 60 that detect transportation of a sheet of paper S are provided in the support plate 53. The sensors 59 and 60 are arranged at predetermined intervals around the central axis TO as the center thereof. In addition, transport rollers 61 and 62, which transport sheets of paper S, are included in the support plate 53. The transport rollers 61 and 62 are rotated by a motor.

When a sheet of paper S is transported to the rotation device 50, both the sensor 59 and the sensor 60 detect the sheet of paper S, the transportation of the sheet of paper S is temporarily stopped, and the slider 57 slides.

As shown in FIG. 10B, when the slider 57 moves in an arrow C direction, the turntable 54 rises. Therefore, the sheet of paper S is nipped between the turntable 54 and the rotation plate 51. When the rotation plate 51 rotates in a state in which the sheet of paper S is nipped between the turntable 54 and the rotation plate 51, the turntable 54 also rotates about the shaft 55 as the center thereof, and the sheet of paper S rotates.

As shown in FIG. 10C, when the slider 57 slides to the original position thereof after the sheet of paper S has rotated, the bottom end of the shaft 55 descends along the tapered surface 58, and the turntable 54 also descends. As a result, the sheet of paper S is separated from the rotation plate 51 and is capable of being conveyed through between the rotation plate 51 and the support plate 53. The sheet of paper S is transported from the rotation device 50 by rotating the transport rollers 61 and 62, and is stacked in the reuse cassette 16 via the transport path 149 and the transport path 145.

In the abovementioned manner, by switching the leading end side and the tailing end side of a sheets of paper S as necessary, sheets of paper S that are transported to the reuse cassette 16 are aligned and stacked so that a side with a fewer marks 32 faces either the leading end side or the tailing end side (refer to FIG. 9C).

In the third embodiment, a rotation control unit 150 is added to the block diagram of FIG. 3. The rotation control unit 150 performs control of the rotation of the rotation plate 51, the movement of the slider 57, and the rotation of the transport rollers 61 and 62 in accordance with detection results of the sensors 59 and 60.

Figure 11:
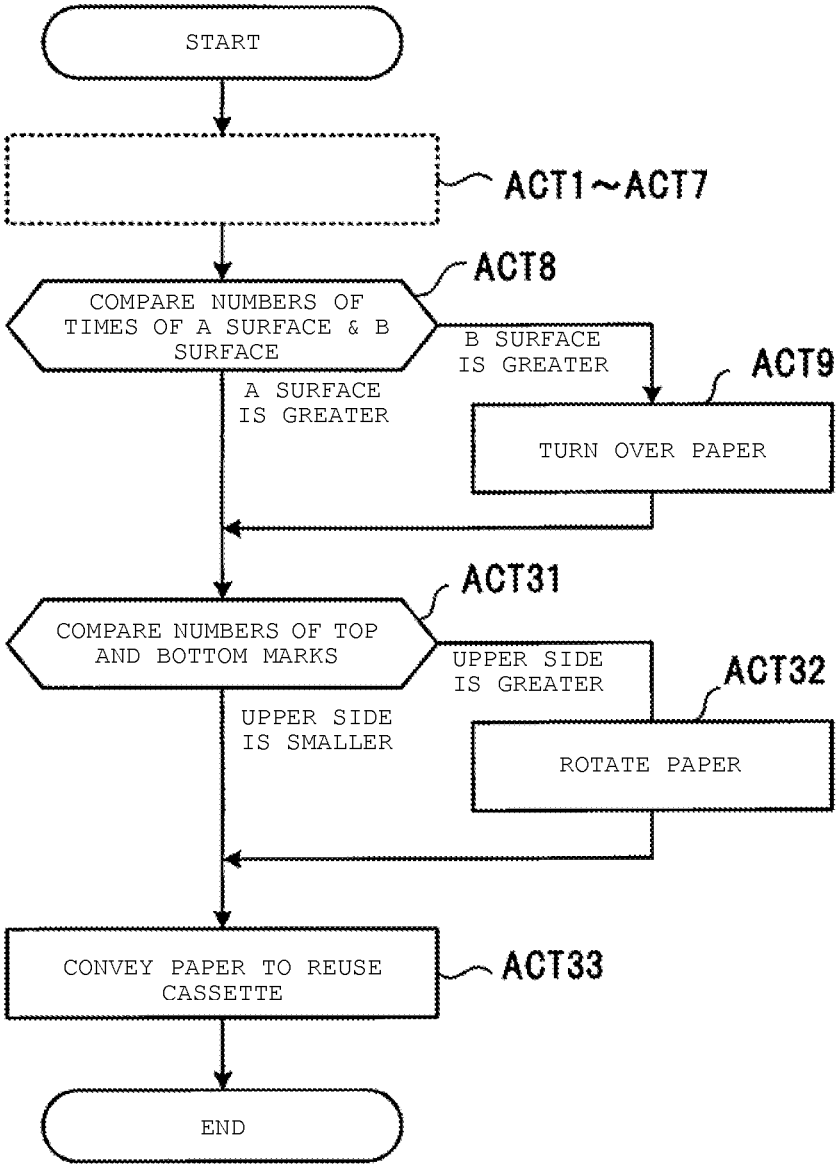
FIG. 11 is a flowchart illustrating sheet transportation carried out by the erasing apparatus according to the third embodiment.

FIG. 11 is a flowchart illustrating transportation of sheets of paper in the erasing apparatus according to the third embodiment. Since ACT1 to ACT7 are the same as ACT1 to ACT7 in FIG. 5, FIG. 11 focuses ACT8 and subsequent steps thereof.

In ACT8, the CPU 101 compares the numbers of reuse times of the A surface and the B surface. When the number of reuse times of the A surface is greater than the number of reuse times of the B surface, the process proceeds to ACT31. Meanwhile, when the number of reuse times of the B surface is greater than the number of reuse times of the A surface, the CPU 101 controls the transport unit 140 to turn over the sheet of paper S and transport the sheet of paper S to the reuse cassette 16 in ACT10.

In ACT31, the CPU 101 compares the number of top and bottom marks 32, which are on the diagonal of the sheet of paper S. For example, when the number of marks on a leading end side (top left) is less than the number of marks 32 on a tailing end side (bottom right), the CPU 101 controls the transport unit 140 to transport the sheet of paper S to the reuse cassette 16 in ACT33.

Meanwhile, when the number of marks on the leading end side (top left) is greater than the number of marks 32 on the tailing end side (bottom right), the CPU 101 controls the transport unit 140 to transport the sheet of paper S to the rotation device 50, and controls the rotation device 50 to rotate the sheet of paper S so that the leading end and the tailing end of the sheet of paper S are switched in ACT32. Then, the CPU 101 controls the transport unit 140 to transport the rotated sheet of paper S to the reuse cassette 16 in ACT33.

According to the third embodiment, it is possible to align and stack sheets of paper so that a surface having fewer marks 32 is facing upward when reusable sheets of paper are transported to the reuse cassette 16. Additionally, the rotation device 50 is not limited to the configuration described above, and may use another mechanism.

In the first, second, and third embodiments, the printing unit 26 is provided in the erasing apparatus in order to print the marks 32, but a printing unit may also be provided in an image formation apparatus. That is, a mark that indicates the number of reuse times may be printed each time an image is formed by the image formation apparatus using a decolorable color material. In this case, the printing unit 26 of the erasing apparatus 10 may not be provided.

Fourth Embodiment

Figure 12:
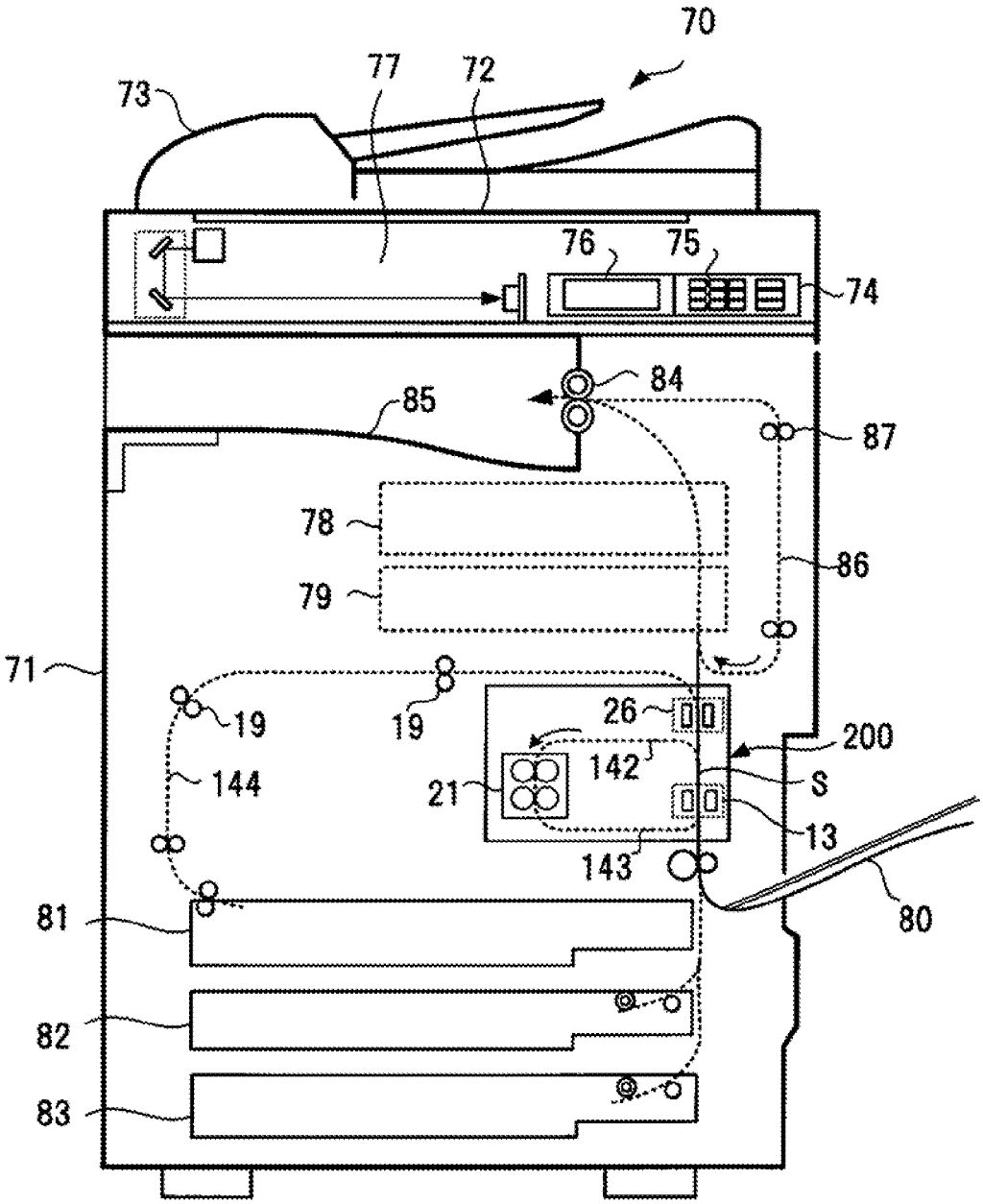
FIG. 12 illustrates an image formation apparatus having an erasing function according to a fourth embodiment.

Next, a configuration of an erasing apparatus according to a fourth embodiment will be described with reference to FIG. 12. FIG. 12 illustrates a configuration of an image formation apparatus that has an erasing function.

In FIG. 12, an image formation apparatus 70 is, for example, a Multi-Function Peripheral (MFP), which is a multifunction machine, a printer, a photocopying machine, or the like. The MFP is described as an example of the image formation apparatus 70.

A document platform 72 is provided on an upper section of a main body 71 of the image formation apparatus 70, and an automatic document feeder (ADF) 73 is provided on the document platform 72 in an openable manner. In addition, a control panel 74 is provided on an upper section of the main body 71. The control panel 74 includes various operational keys 75 and a touch panel type display unit 76. In addition, a scanning unit 77, a first image formation unit 78, and a second image formation unit 79 are included inside the main body 71. The main body 71 also includes a manual tray 80.

Furthermore, a plurality of cassettes 81, 82, and 83, in which various sizes of sheets of paper are stored, are provided in a lower section of the main body 71. For example, the cassette 81 is a reject cassette, and the cassette 82 stores new sheets of paper. The cassette 83 stores reusable sheets of paper (reuse sheets) from which images have been erased.

The scanning unit 77 reads a document that is fed by the ADF 73 or a document that is placed on the document platform 72. The first image formation unit 78 includes a photosensitive drum, developing equipment, transfer equipment, fixing equipment or the like, and forms images on sheets of paper by processing image data that is generated by the scanning unit 77, or image data that is transmitted from a personal computer (PC) or the like.

The first image formation unit 78 forms images on sheets of paper using a non-decolorable toner, the images of which are not erased even if heated. The second image formation unit 79, for example, forms images on sheets of paper using a decolorable color material such as a toner or an ink that contains a leuco dye.

In the following description, a decolorable toner is used as an example of the decolorable color material. Sheets of paper S on which images are formed by the first image formation unit 78 or the second image formation unit 79 are conveyed to a paper discharge roller 84, and are discharged to a paper discharge unit 85 by the paper discharge roller 84.

In addition, an inversion transport path 86 is provided inside the main body 71. The inversion transport path 86 is used when a duplex printing is performed. When the duplex printing is performed, a sheet of paper S is temporarily transported towards the paper discharge unit 85 from the paper discharge roller 84. Then, the sheet of paper S is reversed and transported to the inversion transport path 86. The inversion transport path 86 includes a plurality of transport rollers 87 to convey the sheet of paper S to the second image formation unit 79 and the first image formation unit 78 after inverting the sheet of paper S.

In addition, an erasing apparatus 200 is provided inside the main body 71. Units of the erasing apparatus 200 that have the same functions as those of FIG. 1 are depicted with the same numerals.

The erasing apparatus 200 includes a scanner 13, which is a reading unit, transport paths 142, 143, and 144 through which the sheets of paper are transported, an erasing unit 21, and a printing unit 26. When a reuse sheet of paper is supplied from the manual tray 80, which is a paper supply unit, the erasing apparatus 200 scans images on the sheet of paper S with the scanner 13, generates image data thereof, and reads marks that are printed on the sheet of paper, prior to color-erasing the images.

Furthermore, the erasing apparatus 200 determines a coverage rate and a condition of the sheet of paper S. When, as a result of the reading, the number of reuse times is greater than or equal to N, or deformation such as tearing, creasing, or the like, or damage exist on the sheet of paper S, the sheet of paper S is determined to be non-reusable, and the sheet of paper S is transported to the reject cassette 81 via the transport path 144. In addition, since sheets of paper that have high coverage rage are likely to be curled during the color-erasing, such sheets of paper are determined to be non-reusable and are transported to the reject cassette 81.

Sheets of paper S which do not have any tearing or creasing are transported to the erasing unit 21 via the transport path 142. The erasing unit 21 heats sheets of paper S while the sheets of paper S are nipped between a press roller and a heat roller. Images that are formed on the sheet of paper S are subjected to the color-erasing process by heat. Sheets of paper S that pass through the erasing unit 21 are transported to the scanner 13 again.

The scanner 13 reads the surface of the sheets of paper S again and the CPU 101 (See FIG. 3) determines that images formed with the decolorable color material have been color-erased are reusable, and operates to transport the reusable sheets to the paper discharge unit 85. That is, the paper discharge unit 85 is used as the reuse cassette. A transport path that includes the paper discharge roller 84 and the like is formed between the erasing unit 21 and the paper discharge unit 85, and the reusable sheets are transported to the paper discharge unit 85 via the paper discharge roller 84.

In addition, when images that are formed with a non-decolorable color material images that are handwritten using pens or pencils are determined to remain in an image region, or when sheets of paper S are determined to include tearing and creasing, based on the reading results of the scanner 13, the sheets of paper S are determined to be non-reusable and conveyed to the reject cassette 81.

The image formation apparatus 70 displays a menu on the display unit 76 of a touch panel type, and a user can select an erasure mode and a printing mode. If the erasure mode is selected, images that are formed on sheets of paper using the decolorable toner are subjected to the erasing process by the erasing apparatus 200. At this time, the image formation units 78 and 79 are in a standby state, and do not execute image forming process. In addition, a mark 32 that indicates the number of times images have been erased is printed by the printing unit 26.

When the printing mode is selected, only the scanner 13 in the erasing apparatus 200 becomes active and the erasing process is not performed. When the printing mode is selected, the user can select whether to print using the non-decolorable toner or the decolorable toner. In a mode of printing with the non-decolorable toner, images are formed on sheets of paper by the first image formation unit 78. In a mode of printing with the decolorable toner, images are formed on the sheets of paper by the second image formation unit 79.

Furthermore, the user can also select a mode of printing on the reusable sheets using the decolorable toner. In this mode, images are formed by the image formation unit 79 on the reusable sheets that are stored in the cassette 83, or on reusable sheets that are placed in the manual tray 80. The scanner 13 of the erasing apparatus 200 reads the marks 32 that are printed on the reuse sheets S, and the number of reuse times is determined.

In addition, the printing unit 26 prints a new mark 32 on a sheet of paper each time an image is erased by the erasing apparatus 200. The marks 32 are printed on the front surface and rear surface of a sheet of paper depending on respective numbers of reuse times of each surface.

Furthermore, the erasing apparatus 200 may determine the number of reuse times of a sheet of paper by reading the marks 32. Therefore, when an allowable number of reuse times is set as N, sheets of paper for which the number of reuse times has reached N are and transported to the reject cassette 81. In addition, sheets of paper for which the number of reuse times is N or less are transported to the paper discharge unit 85 so that a surface having fewer marks 32 is on an upper side.

When a sheet of paper S is turned over, the inversion transport path 86 is used. That is, the inversion transport path 86 is a transport path that is primarily used during the duplex printing. In FIG. 12, when the sheet of paper from which images have been erased by the erasing apparatus 200 are turned over, the sheet of paper is conveyed to the inversion transport path 86 from the paper discharge roller 84 using a transport roller 87. It is possible to turn over the front and rear sides of the sheet of paper S by conveying the sheet of paper S to the paper discharge roller 84 via the inversion transport path 86.

In the abovementioned manner, in the image formation apparatus 70 according to the fourth embodiment, it is possible to determine the number of reuse times (number of erases) by counting the marks 32 that are printed on a sheet of paper, and align and stack sheets of paper so that a surface having fewer marks 32 is facing upward when the sheets of paper are determined to be reusable and transported to the paper discharge unit 85.

Therefore, when sheets of paper are reused, it is possible to set the sheets of paper in the cassette 83 for reuse so that images are formed on a surface for which the number of reuse times is smaller. Accordingly, it is possible to reuse both the A surface and the B surface substantially equally, and therefore, it is possible to reduce the occurrence of curling and staining.

In the fourth embodiment, the printing unit 26 is provided in order to print the marks 32. Alternatively, the first image formation unit 78 of the image formation apparatus 70 may be used to print the marks. In this case, the printing unit 26 of the image formation apparatus 70 may not be provided.

While certain embodiments have been described, these embodiments have been presented by way of example only, and are not intended to limit the scope of the invention. Indeed, the novel apparatus and methods described herein may be embodied in a variety of other forms; furthermore, various omissions, substitutions and changes in the form of the apparatus described herein may be made without departing from the spirit of the inventions. The accompanying claims and their equivalents are intended to cover such forms or modifications as would fall within the scope and spirit of the inventions.

What is claimed is:

1. An image erasing apparatus comprising:

a reading unit configured to read one or more identifiers printed on each of first and second surfaces of a sheet;

an erasing unit configured to erase an image formed with a decolorable material on the sheet;

a sheet storage unit;

a conveying unit configured to convey the sheet through the reading unit and the erasing unit to the sheet storage unit and turn over the sheet while conveying the sheet; and a control unit configured to determine a first number of times the first surface of the sheet has been subjected to an erasing process and a second number of times the second surface of the sheet has been subjected to the erasing process, based on the identifiers read by the reading unit, control the conveying unit to turn over the sheet when the first number of times is smaller than the second number of times, and control the conveying unit to convey the sheet without turning over the sheet when the first number of times is greater than the second number of times.

2. The image erasing apparatus according to claim 1, wherein when the first number of times is smaller than the second number of times, the conveying unit conveys the sheet, such that the first surface of the sheet is placed upward in the sheet storage unit, and when the first number of times is greater than the second number of times, the conveying unit conveys the sheet, such that the second surface of the sheet is placed upward in the sheet storage unit.

3. The image erasing apparatus according to claim 1, further comprising:

a sheet holding unit from which the sheet is conveyed to the reading unit, the erasing unit, and the sheet storage unit, in order, wherein when the first surface of the sheet is placed upward in the sheet holding unit and the first number of times is smaller than the second number of times, the first surface of the sheet is placed upward in the sheet storage unit, and when the first surface of the sheet is placed upward in the sheet holding unit and the first number of times is greater than the second number of times, the second surface of the sheet is placed upward in the sheet holding unit.

4. The image erasing apparatus according to claim 1, wherein the sheet storage unit includes a first sheet storage and a second sheet storage, and the control unit is further configured to determine a total of the first and second numbers, control the conveying unit to convey the sheet to the first sheet storage when the total is greater than a predetermined value, and control the conveying unit to convey the sheet to the second sheet storage when the total is smaller than the predetermined value.

5. The image erasing apparatus according to claim 4, wherein the sheet is turned over when the sheet is conveyed to the second sheet storage and the first number of times is smaller than the second number of times, and the sheet is not turned over when the sheet is conveyed to the first sheet storage, or when the sheet is conveyed to the second sheet storage and the first number of times is greater than the second number of times.

6. The image erasing apparatus according to claim 4, wherein the reading unit is further configured to scan the first and second surfaces of the sheet, and the control unit is further configured to determine whether or not the sheet is reusable based on the scanned surfaces, control the conveying unit to convey the sheet to the second sheet storage when the sheet is determined to be reusable, and control the conveying unit to convey the sheet to the first sheet storage when the sheet is determined to be not reusable.

7. The image erasing apparatus according to claim 1, wherein the reading unit is further configured to scan the first and second surfaces of the sheet, before and after the sheet is conveyed through the erasing unit, and the control unit is further configured to determine whether or not an image has been erased from each of the first and second surfaces of the sheet, based on scanned results of the reading unit.

8. The image erasing apparatus according to claim 7, further comprising:

a printing unit configured to print an identifier on the first surface of the sheet, when the control unit determines that the image has been erased from the first surface of the sheet, and on the second surface of the sheet, when the control unit determines that the image has been erased from the second surface of the sheet.

9. The image erasing apparatus according to claim 1, further comprising:

a switching unit configured to change a leading edge of the sheet in a sheet conveying direction without turning over the sheet.

10. The image erasing apparatus according to claim 9, wherein the identifiers are printed in first and second regions of the sheet on a surface thereof, and the control unit is further configured to determine the numbers of the identifier in each of the first and second regions, control the switching unit to change the leading edge of the sheet when the number of the identifier in the first region is greater than the number of the identifier in the second region, and cause the switching unit to not change the leading edge of the sheet when the number of the identifier in the first region is smaller than the number of the identifier in the second region.

11. A method for processing a sheet, comprising:

reading a predetermined region on each of first and second surfaces of a sheet, an identifier being printed in the predetermined region of each surface when an erasing process is performed on that surface;

determining a first number of times the first surface of the sheet has been subjected to an erasing process and a second number of times the second surface of the sheet has been subjected to the erasing process, based on the reading;

turning over the sheet when the first number of times is smaller than the second number of times; and conveying the turned-over sheet to the sheet storage unit when the first number of times is smaller than the second number of times and the sheet to the storage unit when the first number of times is greater than the second number of times.

12. The method according to claim 11, wherein when the first number of times is smaller than the second number of times, the first surface of the sheet is placed upward in the sheet storage unit, and when the first number of times is greater than the second number of times, the second surface of the sheet is placed upward in the sheet storage unit.

13. The method according to claim 11, further comprising:

conveying the sheet from a sheet holding unit for the reading, wherein when the first surface of the sheet is placed upward in the sheet holding unit and the first number of times is smaller than the second number of times, the first surface of the sheet is placed upward in the sheet storage unit, and when the first surface of the sheet is placed upward in the sheet holding unit and the first number of times is greater than the second number of times, the second surface of the sheet is placed upward in the sheet storage unit.

14. The method according to claim 11, wherein the sheet storage unit includes a first sheet storage and a second sheet storage, the method further comprising:

determining a total of the first and second number of times; and conveying the sheet to the first sheet storage when the total is greater than a predetermined value, wherein the turned-over sheet or the sheet is conveyed to the second sheet storage upon determining that the total is smaller than the predetermined value.

15. The method according to claim 11, wherein the sheet storage unit includes a first sheet storage and a second sheet storage, the method further comprising:

scanning an image region of each of the first and second surfaces of the sheet;

determining whether or not the sheet is reusable based on the scanning; and conveying the sheet to the first sheet storage when the sheet is determined to be not reusable, wherein the sheet is conveyed to the second sheet storage upon determined that the sheet is reusable.

16. The method according to claim 11, further comprising:

scanning an image region of each of the first and second surfaces of the sheet;

performing an erasing process on the scanned sheet;

scanning the image region of each of the first and second surfaces of the sheet that has been subjected to the erasing process; and determining whether or not an image in the image region has been erased from each of the first and second surfaces of the sheet, based on the scanning before and after the erasing process.

17. The method according to claim 16, further comprising:

when it is determined that the image has been erased from the first surface of the sheet, printing an identifier on the first surface of the sheet; and when it is determined that the image has been erased from the second surface of the sheet, printing an identifier on the second surface of the sheet.

18. The method according to claim 11, wherein the predetermined region includes first and second region on each of the first and second surfaces of the sheet, the method further comprising:

determining the numbers of the identifier in each of the first and second regions on a surface of the sheet; and when the number of the identifier in the first region is greater than the number of the identifier in the second region, switching a leading edge of the sheet in a sheet conveying direction by rotation of the sheet, before the sheet is conveyed to the sheet storage unit.

19. The method according to claim 18, wherein when the number of the identifier in the first region is smaller than the number of the identifier in the second region, the sheet is conveyed to the sheet storage unit without switching the leading edge of the sheet.

* * * * *